US008960864B2

(12) United States Patent
Min

(10) Patent No.: US 8,960,864 B2
(45) Date of Patent: Feb. 24, 2015

(54) NOZZLE UNIT FOR PRINTER AND PRINTER HAVING THE SAME

(71) Applicant: Samsung Display Co., Ltd., Yongin, Gyeonggi-Do (KR)

(72) Inventor: Kyoung-Wook Min, Yongin (KR)

(73) Assignee: Samsung Display Co., Ltd., Giheung-Gu, Yongin, Gyeonggi-Do (KR)

( * ) Notice: Subject to any disclaimer, the term of this patent is extended or adjusted under 35 U.S.C. 154(b) by 0 days.

(21) Appl. No.: 13/920,195

(22) Filed: Jun. 18, 2013

(65) Prior Publication Data

US 2014/0204152 A1 Jul. 24, 2014

(30) Foreign Application Priority Data

Jan. 23, 2013 (KR) ..... 10-2013-0007655

(51) Int. Cl.
*B41J 2/14* (2006.01)
*B41J 2/04* (2006.01)

(52) U.S. Cl.
CPC ..... *B41J 2/14* (2013.01); *B41J 2002/041* (2013.01)
USPC ..... 347/53; 347/47

(58) Field of Classification Search
None
See application file for complete search history.

(56) References Cited

U.S. PATENT DOCUMENTS

2009/0219343 A1* 9/2009 Kijima et al. ..... 347/53

FOREIGN PATENT DOCUMENTS

| | | |
|---|---|---|
| JP | 2007-62379 | 3/2007 |
| JP | 2007-62381 | 3/2007 |
| KR | 10-2007-0120878 | 12/2007 |
| KR | 10-2012-0041040 | 4/2012 |

OTHER PUBLICATIONS

Wikipedia Article: Ferromagnetic materials, p. 1, Feb. 18, 2014.*
Wikipedia Article: Neodymium magnet, Introduction, Apr. 30, 2014.*

* cited by examiner

*Primary Examiner* — Lisa M Solomon
(74) *Attorney, Agent, or Firm* — Robert E. Bushnell, Esq.

(57) ABSTRACT

A nozzle unit for a printer that includes a sleeve having a guide path formed in the sleeve and through which ink passes, a nozzle hole seat arranged at one end of the sleeve and having a nozzle hole corresponding to the guide path, and a nozzle holder accommodating the sleeve and the nozzle hole seat, having an opening whose diameter is larger than a diameter of the nozzle hole of the nozzle hole seat so that the ink passing through the nozzle hole is externally discharged through the opening, and including a paramagnetic material.

20 Claims, 5 Drawing Sheets

NOZZLE UNIT FOR PRINTER AND PRINTER HAVING THE SAME

CLAIM PRIORITY

This application makes reference to, incorporates the same herein, and claims all benefits accruing under 35 U.S.C. §119 from an application earlier filed in the Korean Intellectual Property Office on 23 Jan. 2013 and there duly assigned Serial No. 10-2013-0007655.

BACKGROUND OF THE INVENTION

1. Field of the Invention

The present invention relates to a nozzle unit for a printer.

2. Description of the Related Art

In general, in the development of high performance nano scale electronic devices, it is necessary to form a patterned organic material layer at a fine pitch. A printer is used to form a fine-pitch patterned organic material layer.

The above information disclosed in this Related Art section is only for enhancement of understanding of the background of the invention and therefore it may contain information that does not form the prior art that is already known to a person of ordinary skill in the art.

SUMMARY OF THE INVENTION

The present invention provides a nozzle unit for a printer which can effectively prevent an unintentional discharge of ink, and a printer having the nozzle unit.

According to an aspect of the present invention, a nozzle unit for a printer includes a sleeve having a guide path formed in the sleeve and through which ink passes, a nozzle hole seat arranged at one end of the sleeve and having a nozzle hole corresponding to the guide path, and a nozzle holder accommodating the sleeve and the nozzle hole seat, having an opening whose diameter may be larger than a diameter of the nozzle hole of the nozzle hole seat so that the ink passing through the nozzle hole may be externally discharged through the opening, and including a paramagnetic material.

The nozzle holder may include at least one of SUS410, SUS430, and Ni.

The nozzle unit may further include a magnetic force generation unit that may be coupled to or accommodated in the nozzle holder. The magnetic force generation unit may include a ferromagnetic material.

The magnetic force generation unit may include a ring shape having an opening portion at a center of the magnetic force generation unit, and the magnetic force generation unit may be coupled to an outer portion of the nozzle holder as the nozzle holder may be inserted in the opening portion of the magnetic force generation unit. The magnetic force generation unit may include a first portion coupled to one side of an outer portion of the nozzle holder, and a second portion coupled to the other side of the outer portion of the nozzle holder, the second portion corresponding to the first portion. Each of the first portion and the second portion of the magnetic force generation unit may have a semicircular shape and the first portion and the second portion may be coupled to the outer portion of the nozzle holder by being separated from each other.

The magnetic force generation unit may include a neodymium magnet.

The magnetic force generation unit may include an electromagnet.

The opening of the nozzle holder may be formed at one end portion of the nozzle holder, and the magnetic force generation unit may be coupled to or accommodated in the other end port of the nozzle holder, the other end portion being arranged opposite to one end portion.

The nozzle unit may further include a blank seat that includes a paramagnetic material and may be capable of blocking the opening of the nozzle holder when the blank seat may be coupled to the nozzle holder by a magnetic force of the magnetic force generation unit. The blank seat may include nickel or a nickel-cobalt alloy.

According to another aspect of the present invention, a printer includes a head having the above nozzle unit, an ink supply tube having one end connected to the nozzle unit and serving as a supply path of ink supplied to the nozzle unit, and a guide unit extending in one direction and guiding the head to move in the one direction or in a direction opposite to the one direction.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings, in which like reference symbols indicate the same or similar components, wherein.

DETAILED DESCRIPTION OF THE INVENTION

Figure 1:
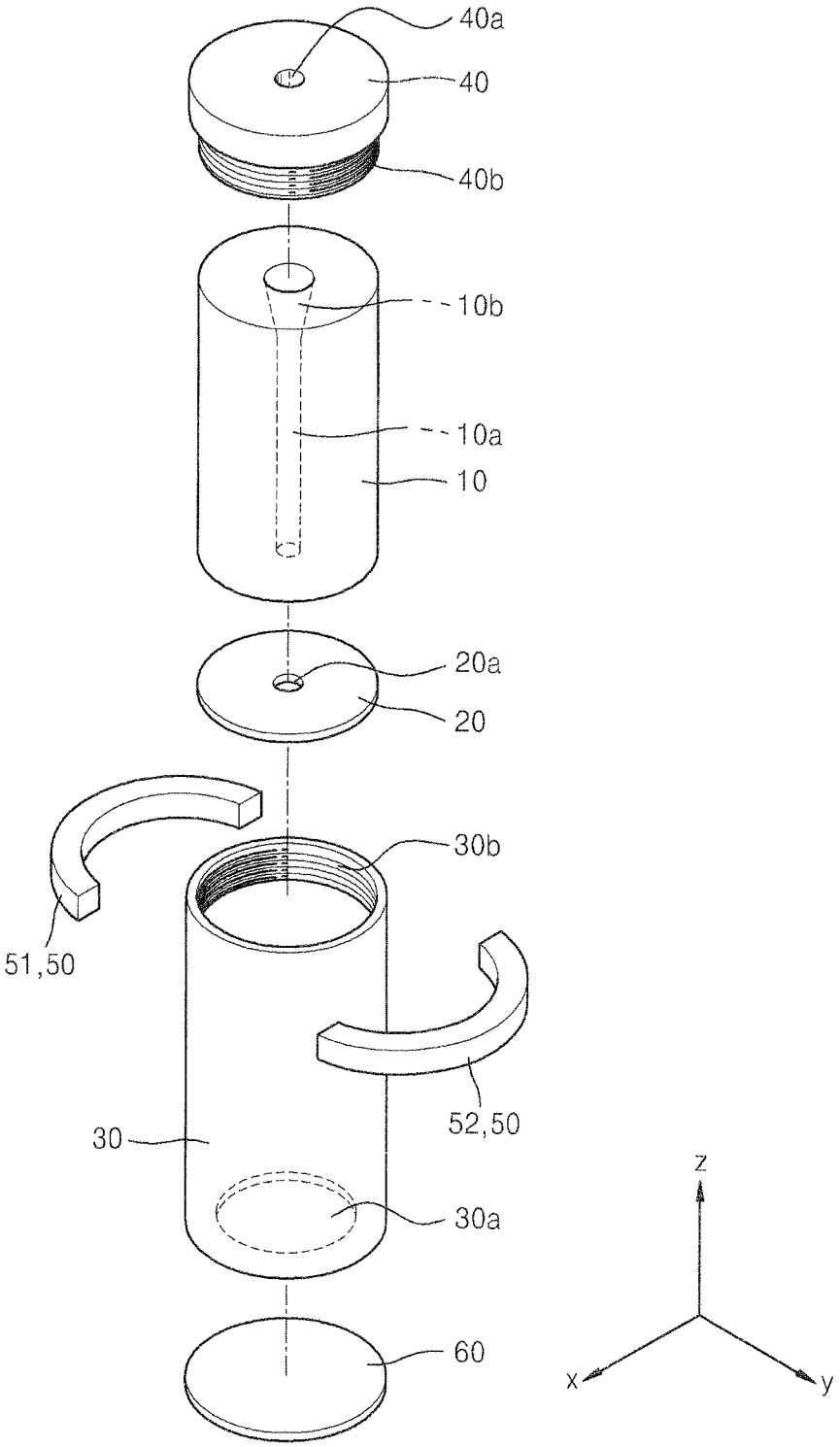
FIG. 1 is an exploded perspective view schematically illustrating a nozzle unit for a printer, according to an embodiment of the present invention.

The attached drawings for illustrating exemplary embodiments of the present invention are referred to in order to gain a sufficient understanding of the present invention, the merits thereof, and the objectives accomplished by the implementation of the present invention. In the drawings, the size of an element may be exaggerated or reduced for clarity. Also, the size and thickness of each element illustrated in the drawings may be exaggerated for convenience of explanation. Hereinafter, the present invention will be described in detail by explaining exemplary embodiments of the invention with reference to the attached drawings. Like reference numerals in the drawings denote like elements.

In the following description, an x-axis, y-axis, and z-axis are not be limited to three axes on a rectangular coordinate system, but may be interpreted as one having a wide meaning including the same. For example, although the x-axis, y-axis, and z-axis may be perpendicular to each other, they may indicate different directions from each other that are not perpendicular to each other.

It will be understood that when an element, such as a layer, a film, a region, or a substrate, is referred to as being "on" another element, it may be directly on the other element or intervening elements may be present.

As used herein, the term "and/or" includes any and all combinations of one or more of the associated listed items. Expressions such as "at least one of," when preceding a list of elements, modify the entire list of elements and do not modify the individual elements of the list.

It will be understood that, although the terms first, second, third etc. may be used herein to describe various elements, components, regions, layers, patterns and/or sections, these elements, components, regions, layers, patterns and/or sections should not be limited by these terms. These terms are only used to distinguish one element, component, region, layer pattern or section from another region, layer, pattern or section. Thus, a first element, component, region, layer or section discussed below could be termed a second element, component, region, layer or section without departing from the teachings of example embodiments.

Spatially relative terms, such as "beneath," "below," "lower," "above," "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

The terminology used herein is for the purpose of describing particular example embodiments only and is not intended to be limiting of the invention. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Example embodiments are described herein with reference to cross sectional illustrations that are schematic illustrations of illustratively idealized example embodiments (and intermediate structures) of the inventive concept. As such, variations from the shapes of the illustrations as a result, for example, of manufacturing techniques and/or tolerances, are to be expected. Thus, example embodiments should not be construed as limited to the particular shapes of regions illustrated herein but are to include deviations in shapes that result, for example, from manufacturing. The regions illustrated in the figures are schematic in nature and their shapes are not intended to illustrate the actual shape of a region of a device and are not intended to limit the scope of the inventive concept.

Unless otherwise defined, all terms (including technical and scientific terms) used herein have the same meaning as commonly understood by one of ordinary skill in the art to which this inventive concept belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

A conventional nozzle unit for a printer or a printer having the nozzle unit may have a problem in that ink may be unintentionally discharged. When ink is discharged for printing from above a predetermined area, a nozzle unit or a head of the printer including the nozzle unit is moved. In doing so, ink in the nozzle unit or in a tube connected to the nozzle unit is discharged due to vibrations or by an external force that is unintentionally applied and thus a printing error may occur.

Figure 2:
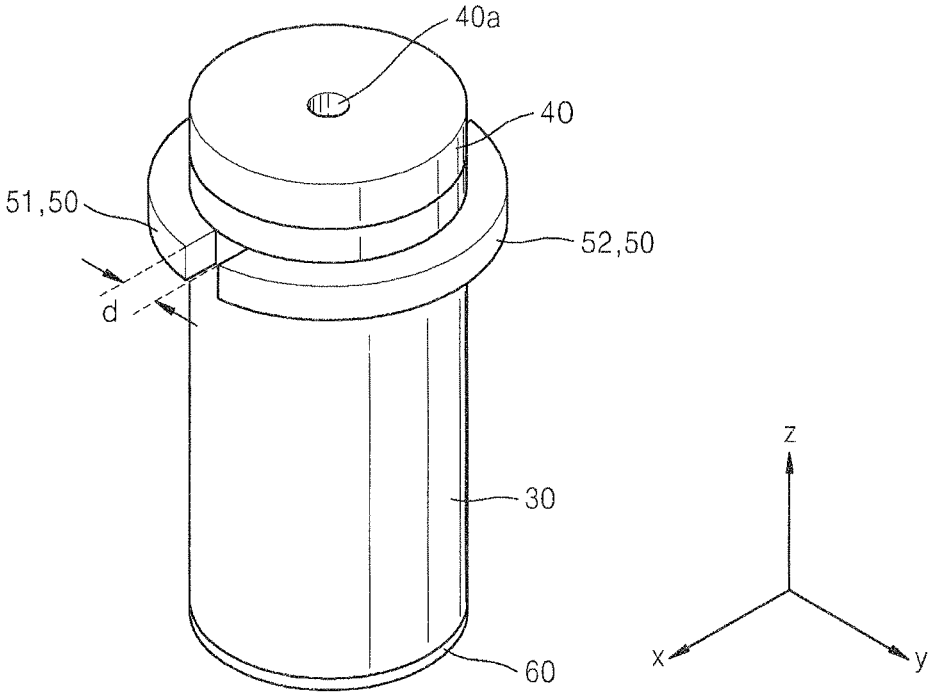
FIG. 2 is a perspective view schematically illustrating the nozzle unit for a printer of FIG. 1.

FIG. 1 is an exploded perspective view schematically illustrating a nozzle unit for a printer according to an embodiment of the present invention. FIG. 2 is a perspective view schematically illustrating the nozzle unit for a printer of FIG. 1.

The nozzle unit for a printer according to the present embodiment includes a sleeve 10, a nozzle hole seat 20, and a nozzle holder 30. A guide path 10*a* (10*b*) for passing ink may be formed inside the sleeve 10. The guide path 10*a* (10*b*) may be a path through which ink that may be supplied to a head 101 (see FIG. 3) via ink supply tubes 119, 129, and 139 (see FIG. 3), which will be described later, pass. The guide path 10*a* (10*b*) extends downwardly (−z direction) so that ink may move downwardly (−z direction)

The term "ink" collectively refers to a material to be discharged from a printer, for example, an organic material that is an element of each pixel of an organic light emitting display device.

The nozzle hole seat 20 may be arranged at one end of the sleeve 10. A nozzle hole 20*a* corresponding to the guide path 10*a* (10*b*) of the sleeve 10 may be formed in the nozzle hole seat 20. The diameter of the nozzle hole 20*a* may be preset according to a printing resolution, and thus a preset amount of ink may be discharged.

The diameter of the guide path 10*a* (10*b*) of the sleeve 10 may be larger than that of the nozzle hole 20*a* of the nozzle hole seat 20. Accordingly, ink may be smoothly supplied toward the nozzle hole seat 20 and simultaneously a preset amount of ink is finally discharged to the outside through the nozzle hole 20*a* of the nozzle hole seat 20.

When the diameter of the guide path 10*a* (10*b*) of the sleeve 10 at a portion close to the nozzle hole seat 20 may be much larger than that of the nozzle hole 20*a* of the nozzle hole seat 20, an excessive amount of ink compared to the amount of ink to be supplied by passing through the nozzle hole 20*a* of the nozzle hole seat 20 may be supplied to the nozzle hole seat 20. As a result, a continuous pressure is generated, which may damage the nozzle hole seat 20 or the nozzle hole 20*a*. To prevent such a problem, the guide path 10*a* (10*b*) of the sleeve 10 may have a first portion 10*a* having a diameter that is uniform and larger, but not excessively larger, than that of the nozzle hole 20*a* of the nozzle hole seat 20, in a portion close to the nozzle hole seat 20 (in the −z direction).

The guide path 10*a* (10*b*) of the sleeve 10 may have a second portion 10*b* in a portion away from the nozzle hole seat 20, the second portion 10*b* having a diameter that decreases toward the first portion 10*a*. Consequently, a diameter of the second portion 10*b* at a certain position may be larger than the diameter of the first portion 10*a*. Thus, the ink that may be externally supplied may be temporarily reserved in the second portion 10*b* and a supply pressure may be reduced accordingly. As a result, when the ink is supplied to the nozzle hole seat 20 through the first portion 10*a*, a pressure applied to the nozzle hole seat 20 may be reduced and thus damage to the nozzle hole seat 20 may be prevented.

Since the guide path 10*a* (10*b*) of the sleeve 10 may be formed in the sleeve 10 extending downwardly (−z direction) as illustrated in FIG. 1, when foreign materials are included in the ink, at least a part of the guide path 10*a* (10*b*) or at least a part of the nozzle hole 20*a* of the nozzle hole seat 20 may be blocked so that printing may not be smoothly performed. To prevent the above, if necessary, a filter unit (not shown) may be located inside or outside the nozzle holder 30, which will be described later, to filter a material injected into the guide path 10*a* (10*b*) of the sleeve 10.

The nozzle hole seat 20 of the sleeve 10 may be accommodated in the nozzle holder 30. The nozzle holder 30 may have a shape of, for example, an empty circular column. An opening 30*a* is formed in one end portion of the nozzle holder 30 and the opening 30*a* has a diameter larger than the diameter of the nozzle hole 20*a* of the nozzle hole seat 20. Accordingly, the ink passing through the nozzle hole 20*a* of the nozzle hole seat 20 may be discharged outwardly through the opening 30*a*. The diameter of the opening 30*a* that is larger than the diameter of the nozzle hole 20*a* of the nozzle hole seat 20 may have no influence on the ink discharged through the nozzle hole 20*a* of the nozzle hole seat 20. The nozzle holder 30 includes a paramagnetic material. The paramagnetic material to be included in the nozzle holder 30 may include SUS410, SUS430, and/or Ni. In other words, the nozzle holder 30 may include at least one of SUS410, SUS430, and Ni.

To fix the positions of the sleeve 10 and the nozzle hole seat 20 in the nozzle holder 30, a nut 40 may be coupled to the other end portion of the nozzle holder 30 as necessary as shown in FIGS. 1 and 2. The nut 40 may have a threaded portion 40*b* on at least a part of an outer surface of a lower portion of the nut 40. The nozzle holder 30 also has a threaded portion 30*b* on at least a part of an inner surface of an upper portion of the nozzle holder 30 and thus the nut 40 may be screw coupled to the nozzle holder 30. While screw coupled to the nozzle holder 40, a lower end portion of the nut 40 (−z direction) contacts an upper end portion of the sleeve 10 (+z direction) so that the positions of the sleeve 10 and the nozzle hole seat 20 under the sleeve 10 may be fixed in the nozzle holder 30.

A guide path 40*a* for passing the ink may be formed in the nut 40. One of the ink supply tubes 119, 129, and 139 may be coupled to an upper end (+z direction) of the guide path 40*a* and thus the ink supplied through the ink supply tubes 119, 129, and 139 may move downwardly (−z direction) via the guide path 40*a* extending downwardly (−z direction). The guide path 40*a* of the nut 40 corresponding to the guide path 10*a* (10*b*) of the sleeve 10 enables the ink that has passed though the guide path 40*a* of the nut 40 to move along the guide path 10*a* (10*b*) of the sleeve 10.

The nozzle unit configured as above may be understood as a portion that receives ink from the ink storage units 113, 123, and 133 (see FIG. 3) and discharges the received ink. The discharged ink may form a droplet at an end portion of the nozzle unit.

In the nozzle unit according to the preset embodiment, since the nozzle holder 30 includes a paramagnetic material, a magnetic force applied to the nozzle holder 30 may be transferred to an external portion around the nozzle holder 30 through the nozzle holder 30. Accordingly, since the nozzle hole 20*a* of the nozzle hole seat 20 can be closed by using the magnetic force, a printing error occurring as the ink in the nozzle unit or in the ink supply tubes 119, 129, and 139 connected to the nozzle unit may be unintentionally discharged due to vibrations or by an unintentionally applied external force during moving of the nozzle unit or the head 101 including the nozzle unit may be effectively prevented, which will be described in detail below.

In the nozzle unit according to the present embodiment, a magnetic force generation unit 50 may be coupled to or accommodated in the nozzle holder 30 as illustrated in FIGS. 1 and 2. It may be understood that the nozzle unit further includes the magnetic force generation unit 50. The magnetic force generation unit 50 includes a ferromagnetic material so as to outwardly exert a magnetic force. The magnetic force generation unit 50 may include, for example, a neodymium magnet or an electromagnet if necessary.

The magnetic force generation unit 50 may be accommodated in the nozzle holder 30 unlike FIGS. 1 and 2 or may be coupled outside the nozzle holder 30 as illustrated in FIGS. 1 and 2. When the magnetic force generation unit 50 may be coupled outside the nozzle holder 30, since the nozzle holder 30 includes a ferromagnetic material as described above, the magnetic force generation unit 50 that generates a magnetic force may be fixedly attached to the nozzle holder 30 by a magnetic force.

When the magnetic force generation unit 50 includes an electromagnet, the magnetic force generation unit 50 cannot generate a magnetic force unless current may be supplied to the magnetic force generation unit 50. Accordingly, in this case, a fixing unit for fixing the magnetic force generation unit 50 to the nozzle holder 30 may be needed and thus the magnetic force generation unit 50 may be accommodated in the nozzle holder 30 to be fixed therein.

As illustrated in FIGS. 1 and 2, the opening 30*a* of the nozzle holder 30 may be formed at one end portion of the nozzle holder 30, and the magnetic force generation unit 50 may be coupled to or accommodated in the other end portion of the nozzle holder 30 that may be opposite to the one end portion.

The magnetic force generation unit 50 may include a first portion 51 coupled to one side of the outer portion of the nozzle holder 30 and a second portion 52 coupled to the other side of the outer portion of the nozzle holder 30 corresponding to the first portion 51, as illustrated in FIGS. 1 and 2. In particular, each of the first and second portions 51 and 52 of the magnetic force generation unit 50 has a semicircular shape. The first portion 51 and the second portion 52 may be coupled to the outside of the nozzle holder 30 by being separated a distance d from each other.

The magnetic force generation unit 50 may be in the form of one body, rather than being separated into the first portion 51 and the second portion 52. However, even when the magnetic force generation unit 50 may be coupled to the nozzle holder 30 by a magnetic force, the magnetic force generation unit 50 and the nozzle holder 30 are not closely coupled to each other and have a gap therebetween, due to a tolerance in a manufacturing process of the magnetic force generation unit 50 or a tolerance in the manufacturing process of the nozzle holder 30. In this case, the coupling between the magnetic force generation unit 50 and the nozzle holder 30 may be degraded and thus the magnetic force generation unit 50 and the nozzle holder 30 may be separated from each other by an external unexpected shock occurring while the nozzle unit or the head 101 including the nozzle unit may be moved.

Thus, the magnetic force generation unit 50 includes the first portion 51 and the second portion 52 and the magnetic force generation unit 50 may be coupled to the outside of the nozzle holder 30 by a magnetic force, the first portion 51 and the second portion 52 are separated the distance d from each other and coupled to the outside of the nozzle holder 30 so that the magnetic force generation unit 50 may be closely coupled to the nozzle holder 30.

In the nozzle unit according to the present embodiment, as illustrated in FIGS. 1 and 2, a blank seat 60 may be coupled to the nozzle holder 30 by the magnetic force generated by the magnetic force generation unit 50. In other words, the nozzle unit further includes the blank seat 60.

The blank seat 60 is a seat having no hole unlike the nozzle hole seat 20 including the nozzle hole 20*a*. As the blank seat 60 includes a paramagnetic material, the blank seat 60 may be coupled to the nozzle holder 30 by a magnetic force of the magnetic force generation unit 50. In this case, the blank seat 60 that may be coupled to the nozzle holder 30 may block the opening 30*a* of the nozzle holder 30. To this end, the blank seat 60 may include nickel or a nickel-cobalt alloy.

In the nozzle unit according to the present embodiment, since the nozzle holder 30 includes the paramagnetic material, the magnetic force generated by the magnetic force generation unit 50 may be transferred to a portion around the opening 30*a* of the nozzle holder 30 via the nozzle holder 30. Accordingly, as the blank seat 60 blocks the opening 30*a* of the nozzle holder 30 by using the magnetic force, the printing error occurring as the ink in the nozzle unit or in the ink supply tubes 119, 129, and 139 connected to the nozzle unit may be unintentionally discharged due to vibrations or by an unintentionally applied external force during moving of the nozzle unit or the head 101 including the nozzle unit may be effectively prevented. As a result, the blocking of the opening 30*a* of the nozzle holder 30 by the blank seat 60 may be understood as blocking of the nozzle hole 20*a* of the nozzle hole seat 20.

Since the blank seat 60 may be coupled to the nozzle holder 30 by the magnetic force of the magnetic force generation unit 50, a user may easily remove the blank seat 60 from the nozzle holder 30 by hand, which will be described later.

Figure 3:
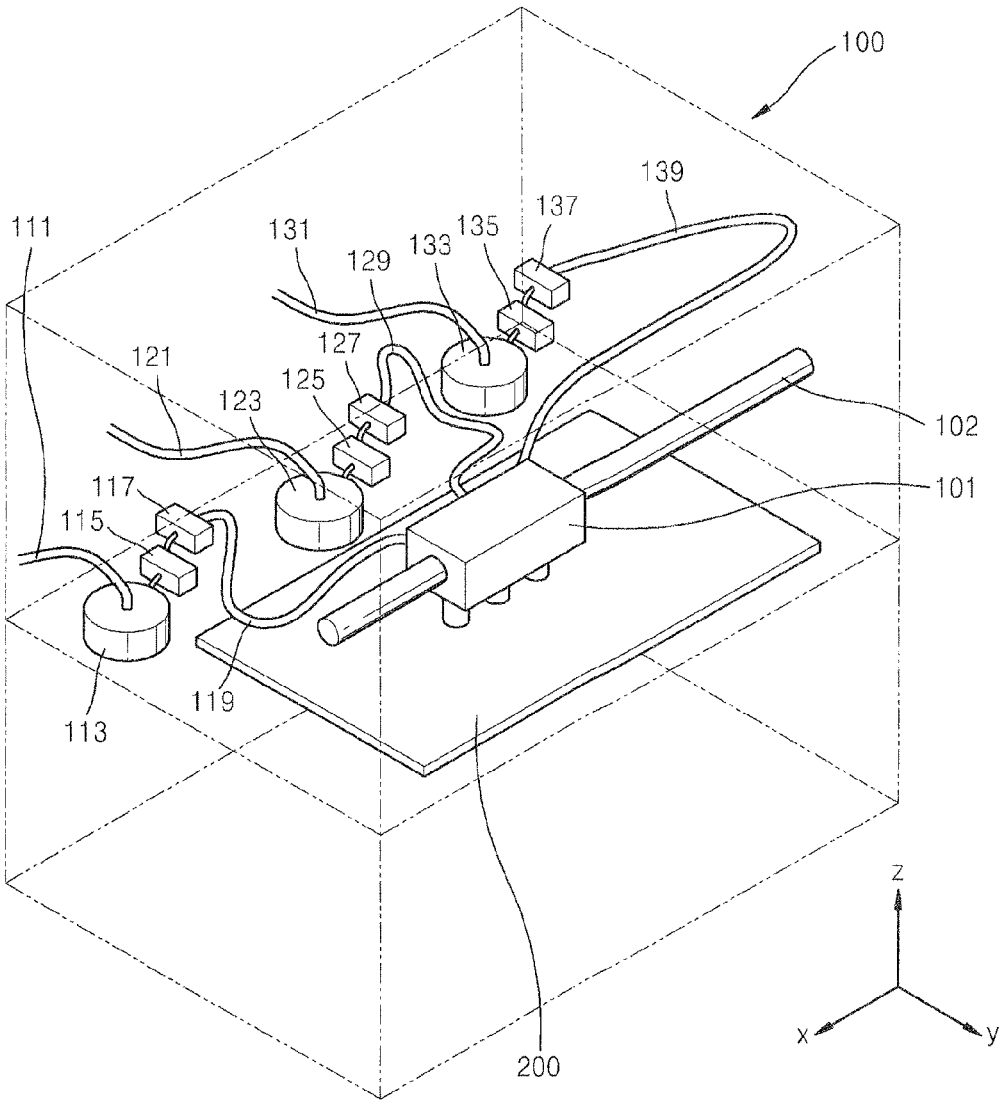
FIG. 3 is a conceptual view schematically illustrating a printer according to another embodiment of the present invention.

FIG. 3 is a conceptual view schematically illustrating a printer 100 according to another embodiment of the present invention. The printer 100 according to the present embodiment includes the head 101 including the nozzle unit according to the above-described embodiment, the ink supply tubes 119, 129, and 139 serving as ink supply paths to supply ink to the nozzle unit, each having one end connected to the nozzle unit, and a guide unit 102 extending in one direction (+x direction) and capable of moving the head 101 in the one direction (+x direction) or in the opposite direction thereto (−x direction)

The printer 100 according to the present embodiment includes the ink storage units 113, 123, and 133 for storing ink to be supplied to the head 101 via the ink supply tubes 119, 129, and 139, and air supply tubes 111, 121, and 131 through which air may be supplied to the ink storage units 113, 123, and 133 to generate pressure in the inside of each of the ink storage units 113, 123, and 133, thereby moving the ink in the ink storage units 113, 123, and 133 to the ink supply tubes 119, 129, and 139, respectively. All of the above elements are not essential, and only some of the elements may be needed in the printer 100 according to the present embodiment.

In FIG. 3, the head 101 includes three nozzle units and the ink supply tubes 119, 129, and 139 are respectively connected to the nozzle units. However, the present invention is not limited thereto. For example, a higher number of nozzle units may be provided, whereas only one nozzle unit may be provided.

When air, such as nitrogen, is supplied to the ink storage units 113, 123, and 133 via the air supply tubes 111, 121, and 131, respectively, the ink stored in the ink storage units 113, 123, and 133 may be pushed toward the ink supply tubes 119, 129, and 139 by the pressure of air such as nitrogen in the ink storage units 113, 123, and 133. Accordingly, the ink may be supplied to the head 101, in detail, to the nozzle unit, via the ink supply tubes 119, 129, and 139. Here, flow control units 115, 125, and 135 such as mass flow controllers (MFCs) or flow rate measurement units 117, 127, and 137 such as mass flow meters (MFMs) may be provided on the ink supply tubes 119, 129, and 139, respectively, and thus the amount of ink supplied to the head 101 and/or the nozzle unit may be accurately controlled and measured.

As described above, the head 101 may move along the guide unit 102 in the one direction (+x direction) and in the opposite direction (−x direction). In doing so, a substrate 200 arranged under the head 101 may be moved in a direction (+y direction) perpendicular to the one direction (+x direction) or in the opposite direction thereto (−y direction) by means of, for example, a carrier (not shown) on a conveyer belt or a rail. Accordingly, the ink discharged from the head 101 can be accurately dropped at a predetermined position on the substrate 200.

Unlike the above description, a variety of modifications are possible. For example, while the position of the substrate 200 may be fixed, the guide unit 102 may be moved by an additional guide unit (not shown) in the direction (+y direction) perpendicular to the one direction (+x direction) or in the opposite direction thereto (−y direction) so that the ink discharged from the head 101 can be accurately dropped onto a predetermined position on the substrate 200.

A conventional printer has a problem of unintentionally discharging ink. In other words, when ink may be discharged for printing from above a preset area, the ink in the nozzle unit or in the ink supply tubes 119, 129, and 139 may be discharged due to vibrations or by an unintentionally applied external force while the nozzle unit or the head 101 including the nozzle unit moves along the guide unit 102, thereby causing a printing error. In particular, the shapes of the ink supply tubes 119, 129, and 139 may be necessarily deformed as the nozzle unit or the head 101 including the nozzle unit moves along the guide unit 102. Accordingly, an unintentional pressure may be applied to the ink in the ink supply tubes 119, 129, and 139 due to the deformation and thus the ink may be discharged out of the nozzle holder.

For example, for the head 101 that includes a plurality of nozzle units, each nozzle unit may have ink containing a different ingredient material. In this case, a process in which printing may be performed by using one nozzle unit of the head 101 while the other nozzle units are not used for the printing may be performed. Thus, in this case, since the blank seat 60 may be coupled to the nozzle holder 30 of each of the other nozzle units by a magnetic force in the printer 100 according to the present embodiment, an unintentional discharge of ink from the other nozzle units may be effectively prevented.

Alternatively, the head 101 may include a plurality of nozzle units and each nozzle unit may have ink containing the same ingredient material. In this case, one nozzle unit of the head 101 may be used for printing while the other nozzle units are used as preliminary nozzle units. In such a state, as the blank seat 60 may be coupled to the nozzle holder 30 of each of the other nozzle units by a magnetic force, the unintentional discharge of ink from the other nozzle units may be effectively prevented.

When at least some of the other nozzle units are to be used in the printing process, a user may easily remove the blank seat 60 coupled to the nozzle holder 30 by a magnetic force, by hand.

Figure 4:
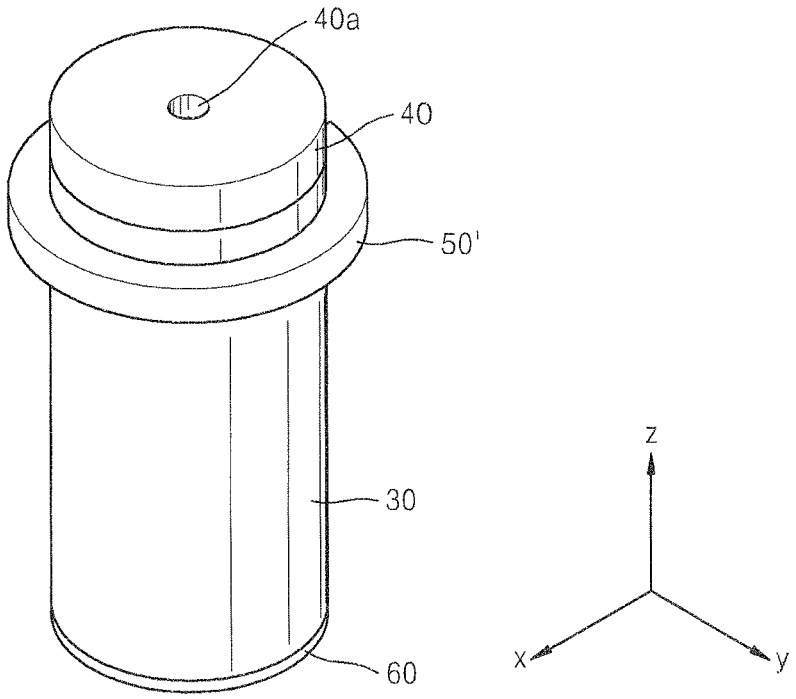
FIG. 4 is a perspective view schematically illustrating a nozzle unit for a printer, according to another embodiment of the present invention.

In the above description, although the magnetic force generation unit 50 is described to include the first portion 51 coupled to one side of the outer portion of the nozzle holder 30 and the second portion 52 coupled to the other side of the outer portion of the nozzle holder 30 corresponding to the first portion 51, the present invention is not limited thereto. FIG. 4 is a perspective view schematically illustrating a nozzle unit for a printer, according to another embodiment of the present invention. Referring to FIG. 4, the magnetic force generation unit 50' has a ring shape having an opening portion at a center thereof. The magnetic force generation unit 50' may be inserted around the opening portion of the magnetic force generation unit 50' so as to be coupled to the outer portion of the nozzle holder 30. In this case, when necessary, a thread may be formed on an inner surface of the opening portion of the magnetic force generation unit 50' and a thread may be formed on an outer surface of the nozzle holder 30. Accordingly, the magnetic force generation unit 50' and the nozzle holder 30 are more firmly screw coupled to each other.

Figure 5:
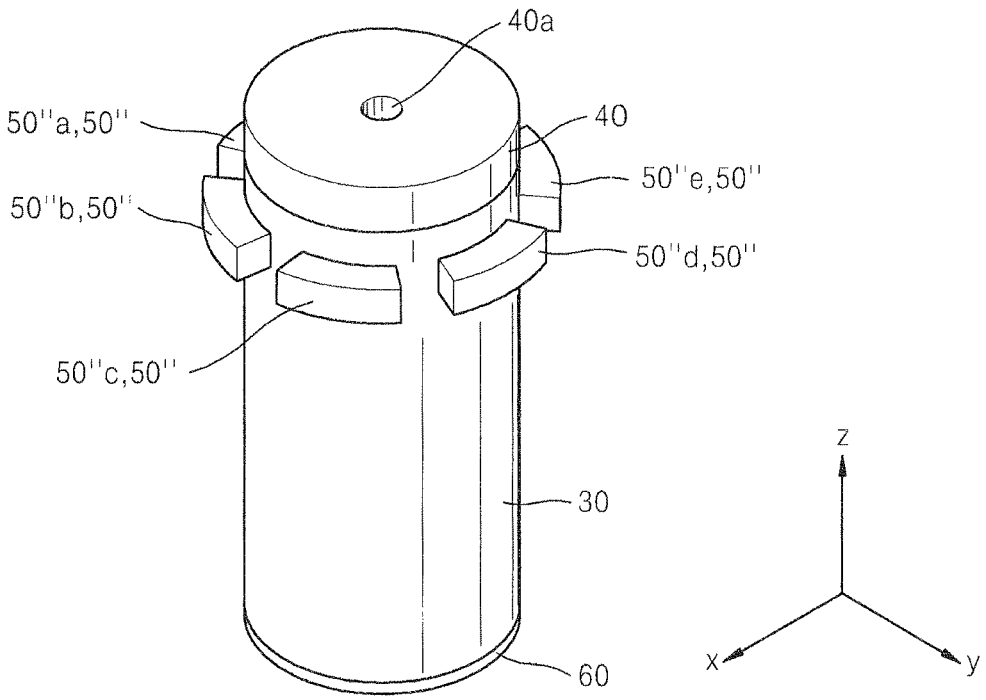
FIG. 5 is a perspective view schematically illustrating a nozzle unit for a printer, according to another embodiment of the present invention.

FIG. 5 is a perspective view schematically illustrating a nozzle unit for a printer, according to another embodiment of the present invention. Referring to FIG. 5, the magnetic force generation unit 50" may include a plurality of portions such as a first portion 50"*a*, a second portion 50"*b*, a third portion 50"*c*, a fourth portion 50"*d*, and a fifth portion 50"*e*. In this case, as the number of the portions may be adjusted as necessary, a level of a coupling force between the blank seat 60 and the nozzle holder 30 may be controlled.

As described above, according to the present invention, a nozzle unit for a printer which can effectively prevent an unintentional discharge of ink, and a printer having the nozzle unit, may be implemented. However, the scope of the present invention is not limited to the effect.

While this invention has been particularly shown and described with reference to exemplary embodiments thereof, it will be understood by those of ordinary skill in the art that various changes in form and details may be made therein without departing from the spirit and scope of the invention as defined by the appended claims.

What is claimed is:

1. A nozzle unit for a printer, the nozzle unit comprising:

a sleeve having a guide path formed in the sleeve and through which ink passes;

a nozzle hole seat arranged at one end of the sleeve and having a nozzle hole corresponding to the guide path; and a nozzle holder accommodating the sleeve and the nozzle hole seat, having an opening whose diameter is larger than a diameter of the nozzle hole of the nozzle hole seat so that the ink passing through the nozzle hole is externally discharged through the opening, and including a paramagnetic material.

2. The nozzle unit of claim 1, wherein the nozzle holder comprises at least one of SUS410, SUS430, and Ni.

3. The nozzle unit of claim 1, further comprising a magnetic force generation unit that is coupled to or accommodated in the nozzle holder.

4. The nozzle unit of claim 3, wherein the magnetic force generation unit comprises a ferromagnetic material.

5. The nozzle unit of claim 4, wherein the magnetic force generation unit has a ring shape having an opening portion at a center of the magnetic force generation unit, and the magnetic force generation unit is coupled to an outer portion of the nozzle holder as the nozzle holder is inserted in the opening portion of the magnetic force generation unit.

6. The nozzle unit of claim 4, wherein the magnetic force generation unit comprises:

a first portion coupled to one side of an outer portion of the nozzle holder; and a second portion coupled to the other side of the outer portion of the nozzle holder, the second portion corresponding to the first portion.

7. The nozzle unit of claim 6, wherein each of the first portion and the second portion of the magnetic force generation unit has a semicircular shape and the first portion and the second portion are coupled to the outer portion of the nozzle holder by being separated from each other.

8. The nozzle unit of claim 4, wherein the magnetic force generation unit comprises a neodymium magnet.

9. The nozzle unit of claim 3, wherein the magnetic force generation unit comprises an electromagnet.

10. The nozzle unit of claim 3, wherein the opening of the nozzle holder is formed at one end portion of the nozzle holder, and the magnetic force generation unit is coupled to or accommodated in the other end port of the nozzle holder, the other end portion being arranged opposite to one end portion.

11. The nozzle unit of claim 3, further comprising a blank seat that comprises a paramagnetic material and is capable of blocking the opening of the nozzle holder when the blank seat is coupled to the nozzle holder by a magnetic force of the magnetic force generation unit.

12. The nozzle unit of claim 11, wherein the blank seat comprises nickel or a nickel-cobalt alloy.

13. A printer, comprising:

a head having a nozzle unit, the nozzle unit comprising:

a sleeve having a guide path formed in the sleeve and through which ink passes;

a nozzle hole seat arranged at one end of the sleeve and having a nozzle hole corresponding to the guide path; and a nozzle holder accommodating the sleeve and the nozzle hole seat, having an opening whose diameter is larger than a diameter of the nozzle hole of the nozzle hole seat so that the ink passing through the nozzle hole is externally discharged through the opening, and including a paramagnetic material;

an ink supply tube having one end connected to the nozzle unit and serving as a supply path of ink supplied to the nozzle unit; and a guide unit extending in one direction and guiding the head to move in a first direction or in a direction opposite to the first direction.

14. The printer of claim 13, further comprising a magnetic force generation unit that is coupled to or accommodated in the nozzle holder.

15. The printer of claim 14, wherein the magnetic force generation unit comprises a ferromagnetic material.

16. The printer of claim 15, wherein the magnetic force generation unit has a ring shape having an opening portion at a center of the magnetic force generation unit, and the magnetic force generation unit is coupled to an outer portion of the nozzle holder as the nozzle holder is inserted in the opening portion of the magnetic force generation unit.

17. The printer of claim 15, wherein the magnetic force generation unit comprises:

a first portion coupled to one side of an outer portion of the nozzle holder; and a second portion coupled to the other side of the outer portion of the nozzle holder, the second portion corresponding to the first portion.

18. The printer of claim 17, wherein each of the first portion and the second portion of the magnetic force generation unit has a semicircular shape and the first portion and the second portion are coupled to the outer portion of the nozzle holder by being separated from each other.

19. The printer of claim 15, wherein the magnetic force generation unit comprises a neodymium magnet.

20. The printer of claim 14, wherein the magnetic force generation unit comprises an electromagnet.

* * * * *